US005088842A

United States Patent [19]

Ito et al.

[11] Patent Number: 5,088,842

[45] Date of Patent: Feb. 18, 1992

[54] DOT MATRIX PRINTER HAVING A PRINT HEAD POSITION ADJUSTING FEATURE DEPENDENT ON AN ECCENTRICITY OF A PLATEN

[75] Inventors: Noritugu Ito, Chita; Yuuji Kawahara, Nagoya, both of Japan

[73] Assignee: Brother Kogyo Kabushiki Kaisha, Aichi, Japan

[21] Appl. No.: 647,820

[22] Filed: Jan. 30, 1991

[30] Foreign Application Priority Data

Jan. 31, 1990 [JP] Japan ..... 2-21406

[51] Int. Cl.[5] ..... B41J 11/20

[52] U.S. Cl. ..... 400/59; 400/124

[58] Field of Search ..... 400/59, 124; 318/685, 318/696

[56] References Cited

U.S. PATENT DOCUMENTS

| | | | |
|---|---|---|---|
| 4,562,153 | 3/1987 | Kotsuzumi et al. | 400/59 |
| 4,676,675 | 6/1987 | Suzuki et al. . | |
| 4,812,059 | 3/1989 | Masaki . | |
| 4,974,974 | 12/1990 | Yoshida et al. | 400/59 |
| 4,990,004 | 2/1991 | Kawashara et al. | 400/59 |

FOREIGN PATENT DOCUMENTS

| | | |
|---|---|---|
| 0292102 | 11/1988 | European Pat. Off. . |
| 0336870 | 10/1989 | European Pat. Off. . |
| 624050 | 7/1981 | Switzerland . |
| 1589356 | 5/1981 | United Kingdom . |

*Primary Examiner*—Eugene H. Eickholt
*Attorney, Agent, or Firm*—Oliff & Berridge

[57] ABSTRACT

For dot impact printers having a platen which may be installed such that the geometric central axis thereof is displaced off a rotation axis about which the platen rotates, a carriage on which a print head is mounted is moved toward the platen from a predetermined position until the distal end portion of the carriage is brought in abutment with the circumference of the platen to thereby measure the surface level of the platen. This measurement is repeatedly carried out while angularly rotating the platen. The thus measured surface levels of the platen are averaged, and based on the average data an optimum position of the print head to be located apart from the sheet of print paper supported on the platen is determined.

17 Claims, 6 Drawing Sheets

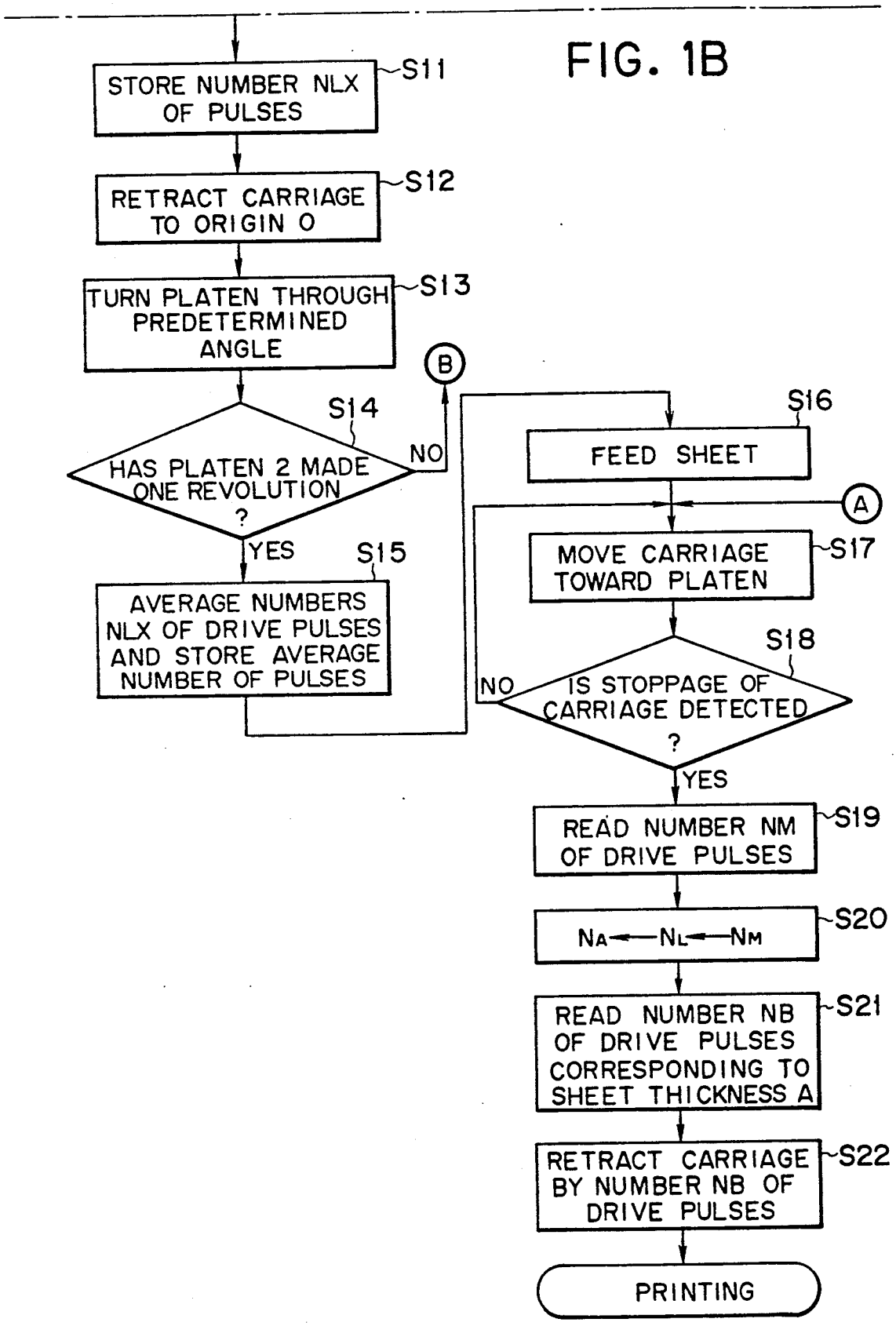
FIG. 1B
STORE NUMBER NLX OF PULSES
S11
RETRACT CARRIAGE TO ORIGIN O
S12
TURN PLATEN THROUGH PREDETERMINED ANGLE
S13
B
S14
HAS PLATEN 2 MADE ONE REVOLUTION ?
NO
YES
S15
AVERAGE NUMBERS NLX OF DRIVE PULSES AND STORE AVERAGE NUMBER OF PULSES
S16
FEED SHEET
A
MOVE CARRIAGE TOWARD PLATEN
S17
S18
IS STOPPAGE OF CARRIAGE DETECTED ?
NO
YES
READ NUMBER NM OF DRIVE PULSES
S19
NA ← NL ← NM
S20
READ NUMBER NB OF DRIVE PULSES CORRESPONDING TO SHEET THICKNESS A
S21
RETRACT CARRIAGE BY NUMBER NB OF DRIVE PULSES
S22
PRINTING

DOT MATRIX PRINTER HAVING A PRINT HEAD POSITION ADJUSTING FEATURE DEPENDENT ON AN ECCENTRICITY OF A PLATEN

BACKGROUND OF THE INVENTION

The present invention relates to a printer such as a dot matrix printer.

Wire-dot-impact printers have a carriage slidably movable on a guide rod along a platen, a print head for projecting and retracting print wires from and into its distal end, and an ink ribbon. A sheet of print paper is set on the platen and fed as the platen rotates about its own axis. Then, the print wires are selectively controlled to strike the sheet of print paper through the ink ribbon to thereby print desired information on the sheet of print paper. In order to achieve appropriate printing in such printers, it is necessary that a suitable gap be present between the sheet of print paper and the distal end (print wires) of the print head.

Recently, there has been developed a printer which incorporates an adjusting mechanism for automatically adjusting the gap between the sheet of print paper and the print head. The adjusting mechanism includes a pressing/releasing mechanism for moving the carriage toward and away from the platen through angular movement of the guide rod about an axis which is displaced eccentrically off the geometric central axis of the guide rod. Before a printing process is carried out, a ribbon mask on the distal end of the carriage is pressed under predetermined pressure against the sheet of print paper on the platen by the pressing/releasing mechanism, and thereafter the carriage is moved a suitable distance away from the platen by the pressing/releasing mechanism.

When the printer is shipped from the factory, a control device comprising a microcomputer or the like, which controls the printer, stores, as a reference position, the position of the carriage at the time the ribbon mask is pressed against the platen under a pressure which is the same as the above predetermined pressure. The thickness of the sheet of print paper is detected as the difference between the reference position and the position of the carriage when the ribbon mask is pressed against the sheet of print paper. The carriage is displaced from the sheet of print paper by a preset distance which corresponds to the detected thickness of the sheet of print paper. Therefore, the print head can print desired information on any of various sheets of print paper having various thicknesses, while being spaced from the sheet of print paper by a distance suitable for printing.

The platen is driven to rotate about its own axis by a motor and hence serves as a sheet feed mechanism. However, the platen is not constructed with high accuracy for reasons in connection with the manufacture thereof, and may be installed such that the geometric central axis thereof is displaced, though slightly, off the axis (rotational axis) about which the platen is rotatable. If the platen is thus eccentrically positioned, then different positions on the circumference of the platen are spaced different distances from the rotational axis of the platen.

The conventional adjusting mechanism, as described above, is based on the assumption that the circumferential surface of the platen is of a true circle spaced equally from the rotational axis, and regards, as the reference position, the position of the carriage at the time it is pressed against the platen at a certain position thereon. Therefore, if the geometrical central axis of the platen is displaced off the rotational axis, then the following problems arise: When the carriage is pressed against a circumferential area of the platen which is spaced a larger distance from the rotational axis thereof than other circumferential areas of the platen in order to determine the reference position for the carriage, the reference position which is determined is located closer to the carriage than a standard circumferential surface of the platen, which is spaced a standard distance from the rotational axis of the platen. If the carriage is spaced a certain distance from that reference position, then the gap between the sheet of print paper and the print head is so large that the density of printed information on the sheet of print paper may be too low or some dots to be printed may not be printed on the sheet of print paper.

On the other hand, when the carriage is pressed against a circumferential area of the platen which is spaced a smaller distance from the rotational axis thereof than other circumferential areas of the platen in order to determine the reference position for the carriage, the reference position which is determined is located radially inwardly of the standard circumferential surface of the platen. If the carriage is spaced a certain distance from that reference position, then the gap between the sheet of print paper and the print head is so small that the density of printed information on the sheet of print paper may be too high or the ink ribbon may be caught by the print head.

The conventional adjusting mechanism, therefore, may fail to establish a reference position with respect to the standard circumferential surface of the platen. As a consequence, the print head may not be spaced a suitable gap from the sheet of print paper on the platen, resulting in a reduction in the print quality.

SUMMARY OF THE INVENTION

In view of the aforesaid problems of the conventional printers, it is an object of the present invention to provide a printer which is capable of suitably adjusting the gap between a sheet of print paper and a print head even if the geometrical central axis of a platen is displaced off the rotational axis thereof.

According to the present invention, there is provided a printer which comprises a power supply switch for actuating the printer when the power supply switch is turned on; a platen rotatable about its own axis for supporting a sheet of print paper on a circumference thereof; a guide rod extending in parallel to the axis of the platen; a carriage slidably movable along the guide rod and also movable toward and away from the platen in a direction substantially perpendicular to the axis of the platen, the carriage having a distal end portion confronting the platen; a print head mounted on the carriage for carrying out printing on the sheet of print paper while the carriage is moving along the guide rod; a pressing/releasing mechanism for moving the carriage toward and away from the platen; reference position detecting means for detecting a plurality of reference positions of the carriage in the direction perpendicular to the axis of the platen under a condition where no sheet of print paper is supported on the platen,. the plurality of reference positions being defined by positions of the distal end portion of the carriage when pressed against a plurality of locations on the circumference of the platen by the pressing/releasing mechanism, the platen being angularly rotated about its own axis when the plurality of reference positions are detected, the reference position detecting means producing a plurality of reference position data each indicative of the detected reference position of the carriage; averaging means for averaging the plurality of reference position data produced by the reference position detecting means and producing average reference position data indicative of an averaged reference position of the carriage; memory means for storing the average reference position data; and adjusting means for adjusting a position of the carriage by actuating the pressing/releasing mechanism based on the average reference position data stored in the memory means.

The printer further comprises sheet thickness detecting means for detecting a thickness of the sheet of print paper supported on the platen, the sheet thickness detecting means producing sheet thickness data indicative of the detected thickness of the sheet of print paper, and wherein the adjusting means adjusts the position of the carriage based further on the sheet thickness data.

The pressing/releasing mechanism includes a motor, such as stepping motor, for actuating the pressing-/releasing mechanism, the motor being rotated when drive pulses are supplied thereto, and wherein each of the plurality of reference position data is in the form of a number of drive pulses supplied to the motor needed for moving the carriage from a predetermined position spaced apart a predetermined distance from the circumference of the platen to the reference position, the average reference position data represents an average number of the drive pulses, and the sheet thickness data is in the form of a number of drive pulses corresponding to the thickness of the sheet of print paper. The sheet thickness detecting means counts a number of drive pulses supplied to the motor during a movement of the carriage from the predetermined position until the distal end portion of the carriage is pressed against the sheet of paper supported on the platen, and produces the sheet thickness data by subtracting the counted number of drive pulses from the average number of the drive pulses represented by the average reference position data.

The memory means further stores carriage position data regarding optimum positions of the carriage to be located apart from the sheet of print paper supported on the platen in relation to the sheet thickness data, the position of the carriage being adjusted by the adjusting means in response to the carriage position data corresponding to the sheet thickness data produced by the sheet thickness detecting means. The adjusting means adjusts the position of the carriage by moving the carriage away from the sheet of print paper supported on the platen.

With the above arrangement, the average reference position data represents an average of the reference position data detected with respect to the plural locations on the circumference of the platen. Therefore, even if the geometrical central axis of the platen is displaced off the rotational axis thereof, it is possible to obtain averaged level of the circumference of the platen.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 1 is a flowchart of a process for adjusting a gap between a sheet of print paper on a platen and a print head in a printer;

FIGS. 1A and 1B are detailed portions of the FIG. 1 flowchart;

DETAILED DESCRIPTION OF THE PREFERRED EMBODIMENTS

An embodiment of the present invention as it is applied to a dot matrix printer will hereinafter be described with reference to the drawings.

Figure 2:
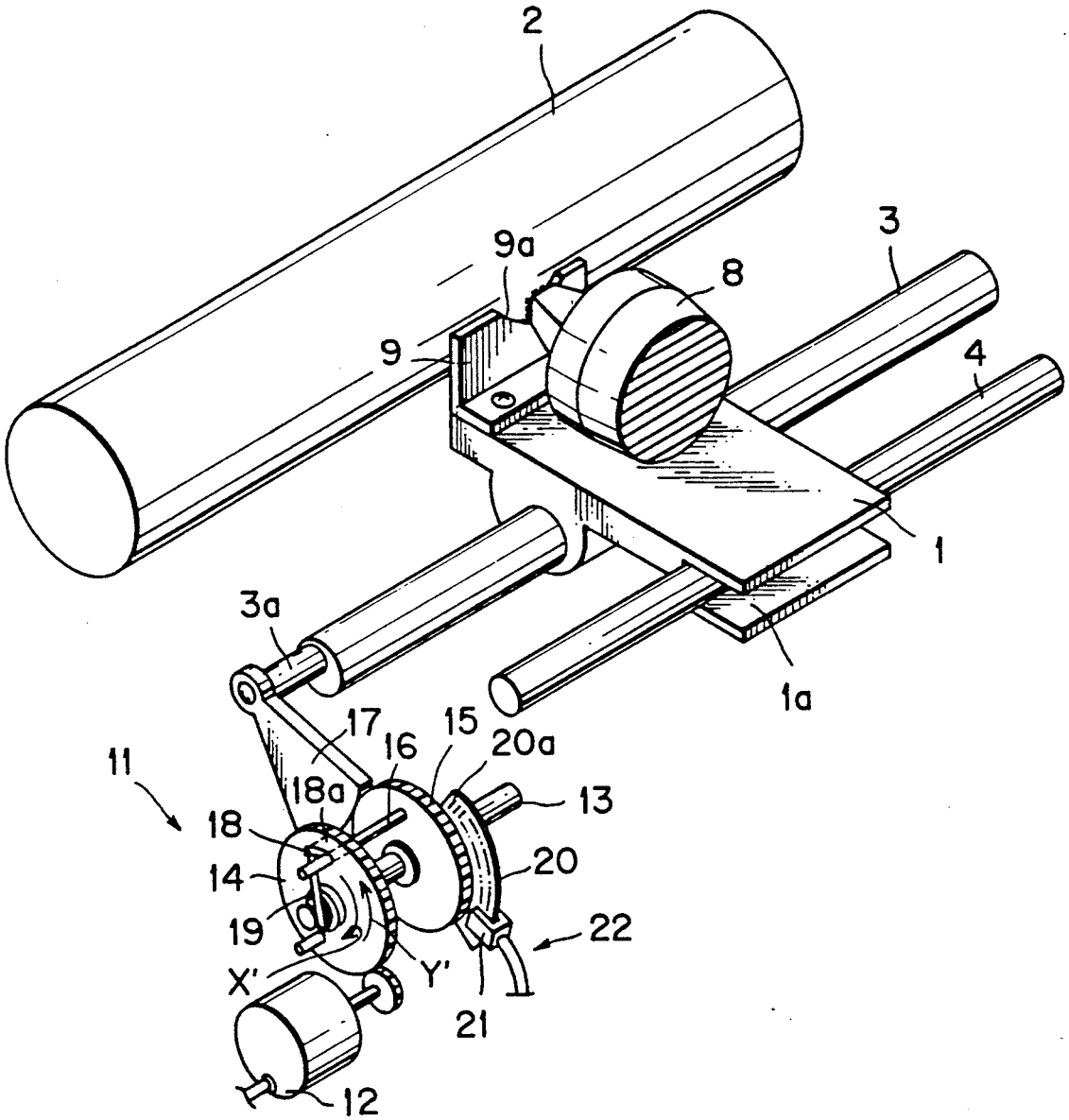
FIG. 2 is a perspective view of a portion of the printer.

FIG. 2 schematically shows a portion of a dot matrix printer. As shown in FIG. 2, a carriage 1 is slidably mounted on a guide rod 3 extending along a platen 2. The carriage 1 has a groove 1*a* formed in an end portion thereof remote from the platen 2, and a fixed rod 4 which extends in a direction in parallel to the guide rod 3 is loosely fitted in the groove 1*a*. The carriage 1 moves along the guide rod 3 by a known carriage actuating mechanism which comprises a pair of pulleys (not shown), a belt (not shown) and a motor 5 (see FIG. 3) for actuating the carriage 1. As shown in FIGS. 4(*a*), 4(*b*), 4(*c*), and 6, a sheet sensor 7 for detecting whether a sheet 6 of print paper is set on the platen 2 is disposed near the platen 2.

A print head 8 of the dot-matrix-impact type is mounted on the carriage 1 in confronting relation to the platen 2. A replaceable ink ribbon cassette (not shown) is also mounted on the carriage 1. The carriage 1 also supports, on its distal end facing the platen 2, a ribbon mask 9 for preventing the sheet 6 of print paper from being smeared by an ink ribbon (not shown) travelling between the print head 8 and the sheet 6 of print paper. As is well known in the art, the print head 8 has vertical arrays of print wires on its distal end which print wires can be projected toward the platen 2 to press the ink ribbon forwardly through a hole 9*a* formed in the ribbon mask 9. While the carriage 1 is in motion, the print head 8 moves laterally with respect to the sheet 6 of print paper 6 set on the platen 2, and selectively actuates the print wires to thus make dot impression on the sheet 6 through the ink ribbon. As shown in FIGS. 4(*a*) through 4(*c*), the platen 2 has a shaft 2*a* on each of its opposite ends, the shaft 2*a* being rotatably supported on a printer housing. The platen 2 is rotatable about a rotational axis 0 by a sheet feed mechanism 10 (see FIG. 3) including a motor (not shown). The sheet 6 of print paper is fed onto the platen 2 by the sheet feed mechanism 10.

In order to achieve appropriate printing with the print head 8, it is necessary that a suitable gap G be present between the sheet 6 of print paper and the distal end of the print head 8. A mechanism for adjusting the gap G will now be described below.

As shown in FIG. 2, the guide rod 3 has, on each of its opposite ends, an integral eccentric shaft 3*a* (only one shown) which is displaced off the geometric central axis of the guide rod 3. The eccentric shaft 3*a* is rotatably supported on a side panel of the printer housing. Therefore, the guide rod 3 is angularly movable about an axis which is displaced off the geometric central axis thereof, in the direction indicated by an arrow X or Y (FIG. 5), for thereby moving the carriage 1 toward or away from the platen 2. One of the eccentric shafts 3*a* (which is shown in FIG. 2) is coupled to a pressing-/releasing mechanism 11 which angularly moves the guide rod 3 in one direction or the other. The pressing-/releasing mechanism 11 includes a stepping motor 12 whose rotative power is transmitted at a certain speed reduction ratio to a drive gear 14 that is rotatably mounted on a shaft 13. The rotation of the drive gear 14 is transmitted through a pin 16 to a driven gear 15 which is also rotatably mounted on the shaft 13. The rotation of the driven gear 15 is then transmitted to a sector swing gear 17 connected to an outer end of the eccentric shaft 3*a*. The pin 16 has one end fixed to the driven gear 15 and the other end extending through an arcuate slot 18 defined circumferentially in the drive gear 14. The pin 16 is normally urged against one end 18*a* of the arcuate slot 18 by a torsion coil spring 19 coupled to the drive gear 14.

When the stepping motor 12 rotates in a normal direction, the drive gear 14 rotates in the direction indicated by an arrow Y', and the rotation of the drive gear 14 is immediately transmitted to the driven gear 15. The guide rod 3 is angularly moved in the direction indicated by the arrow Y (see FIG. 5) to retract the carriage 1 away from the platen 2. When the stepping motor 12 rotates in the opposite direction, the drive gear 14 rotates in the direction indicated by an arrow X', and the rotation of the drive gear 14 is transmitted through the torsion coil spring 19 and the pin 16 to the driven gear 15. The guide rod 3 is angularly moved in the direction indicated by the arrow X (see FIG. 5) to move the carriage 1 toward the platen 2. At this time, the movement of the carriage 1 toward the platen 2 is stopped when the ribbon mask 9 on the distal end of the carriage 1 abuts against the platen 2 or the sheet 6 of print paper set on the platen 2. When the load torque imparted on the driven gear 15 exceeds a predetermined level due to the stoppage of the carriage 1, the torsion coil spring 19 is elastically deformed, and no rotation is transmitted to the pin 16, thus stopping the driven gear 15. Stated otherwise, the force with which the carriage 1 abuts against the platen 2 or the sheet 6 of print paper corresponds to the spring force produced by the torsion coil spring 19.

The pressing/releasing mechanism 11 also has an encoder 22 comprising a rotary disc 20 mounted on the driven gear 15 and having an arcuate array of slits 20*a* and a photointerrupter 21 for detecting a light beam as it passes through and is blocked by the rotary disc 20. The encoder 22 serves to detect when the driven gear 15 is stopped in response to engagement of the carriage 1 with the platen 2 or the sheet 6 of print paper, and also to stop the carriage 1 in a position (hereinafter referred to as "an origin O") sufficiently spaced from the platen 2. An output signal from the encoder 22 is supplied to a control device 23 (FIG. 3) described below.

Figure 3:
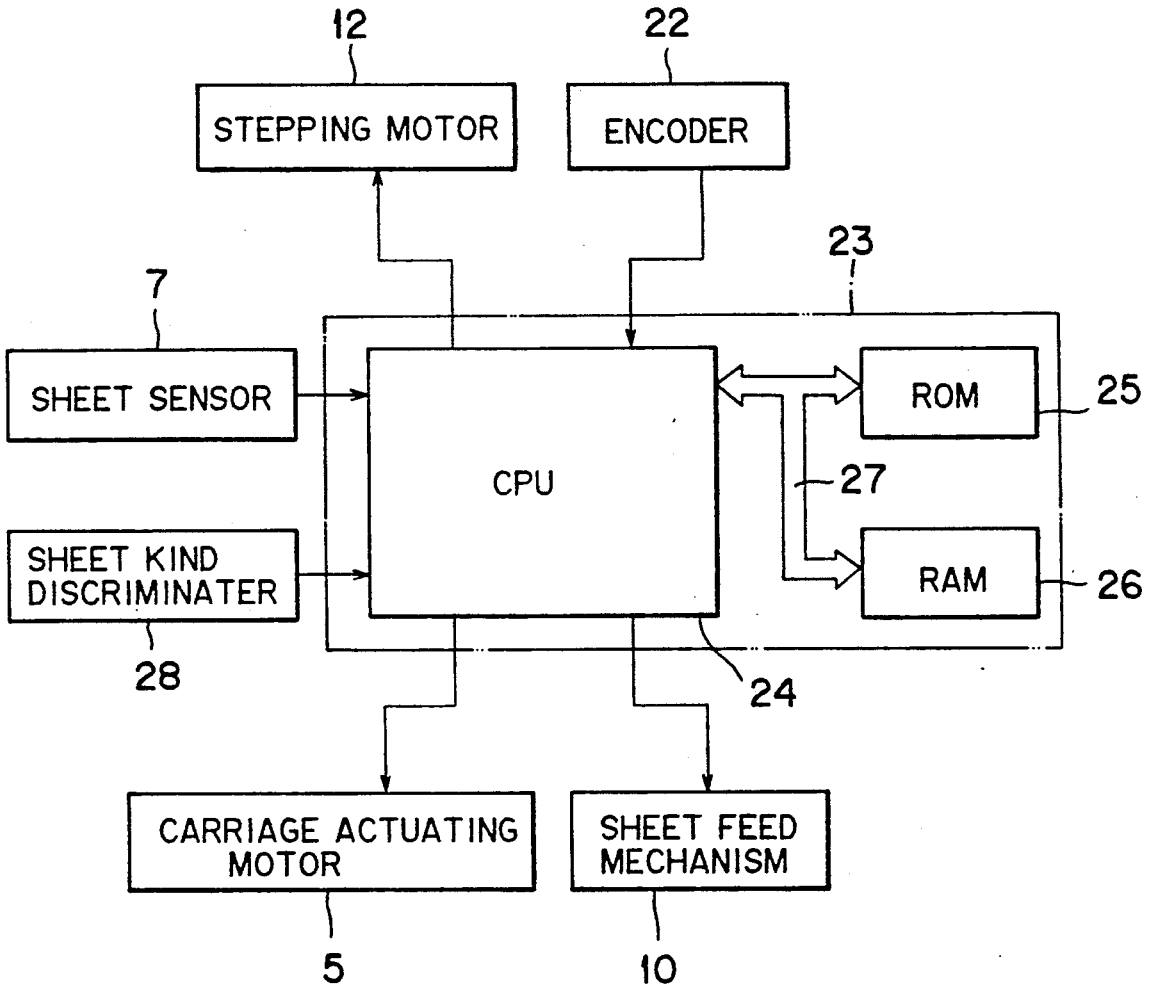
FIG. 3 is a block diagram of the printer.
Figure 4A:
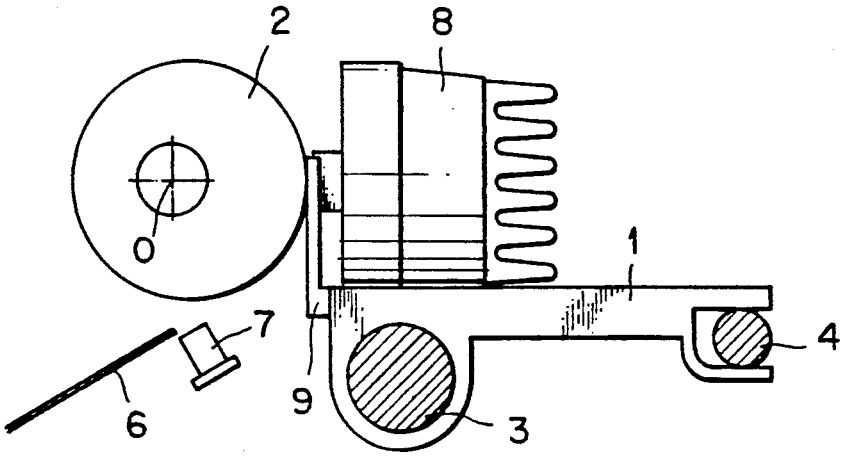
FIG. 4(*a*), 4(*b*), and 4(*c*) are vertical sectional side elevational views showing a carriage and a platen whose rotational axis is shown, somewhat exaggerated, displaced off the geometric central axis thereof, the views illustrating the platen in respective different 45 degrees spaced angular positions with respect to the carriage.
Figure 4B:
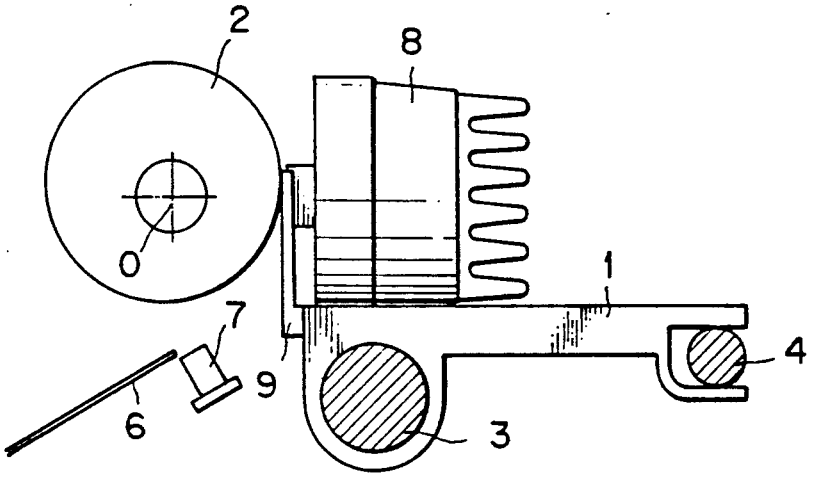
Figure 4C:
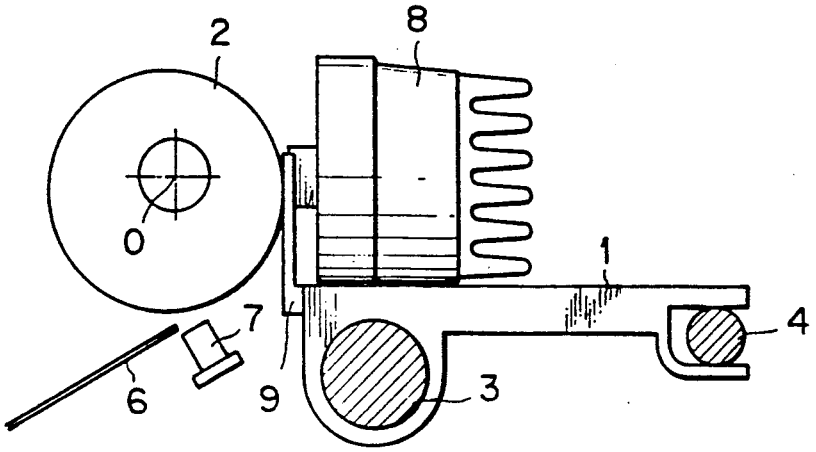

As shown in FIG. 3, the control device 23 comprises a CPU (central processing unit) 24, a ROM (read-only memory) 25 for storing a program and data, a RAM (random access memory) 26 for temporarily storing various data, and a bus 27 interconnecting the CPU 24, the ROM 25, and the RAM 26. Responsive to the output signals from the sheet sensor 7 and the encoder 22, the control device 23 controls energization and de-energization of the stepping motor 12 and the sheet feed mechanism 10, and provides various means defined in the present invention.

The control device 23 counts drive pulses supplied to the stepping motor 12 after it is energized and until it is deenergized, so that the distance which the carriage 1 has moved from the origin O is detected as the number of drive pulses supplied to the stepping motor 12. The ROM 25 in the control device 23 stores data representing the number NB of drive pulses to be supplied to the stepping motor 12 to move the carriage 1 from the sheet 6 of print paper by a distance which is suitable to provide a gap G optimum for printing. In the present embodiment, the optimum gap G varies with the thickness A (corresponding to the number NA of drive pulses, described later on) of the sheet 6 of print paper. The gap G for a thicker sheet 6 of print paper is smaller than a thinner sheet 6 of print paper, thereby allowing the print head 8 to produce a greater impact force on the sheet 6 of print paper. Therefore, the ROM 25 stores different data items for the number NB of drive pulses, which data items correspond to different sheet thicknesses or numbers NA of drive pulses.

The control device 23 also serves to control the carriage actuating mechanism. The printer has a sheet kind discriminator 28 (FIG. 3) such as a limit switch or the like for detecting whether the sheet 6 of print paper is a single sheet or a fanfold sheet. An output signal from the sheet kind discriminator 28 is also supplied to the control device 23.

Operation of the printer will be described below. When a power supply switch (not shown) of the printer is turned on, the control device 23 is energized to adjust the gap G between the sheet 6 of print paper and the distal end of the print head 8 according to a procedure or program shown in the flowchart of FIG. 1, which is stored in the ROM 25.

Figure 1A:
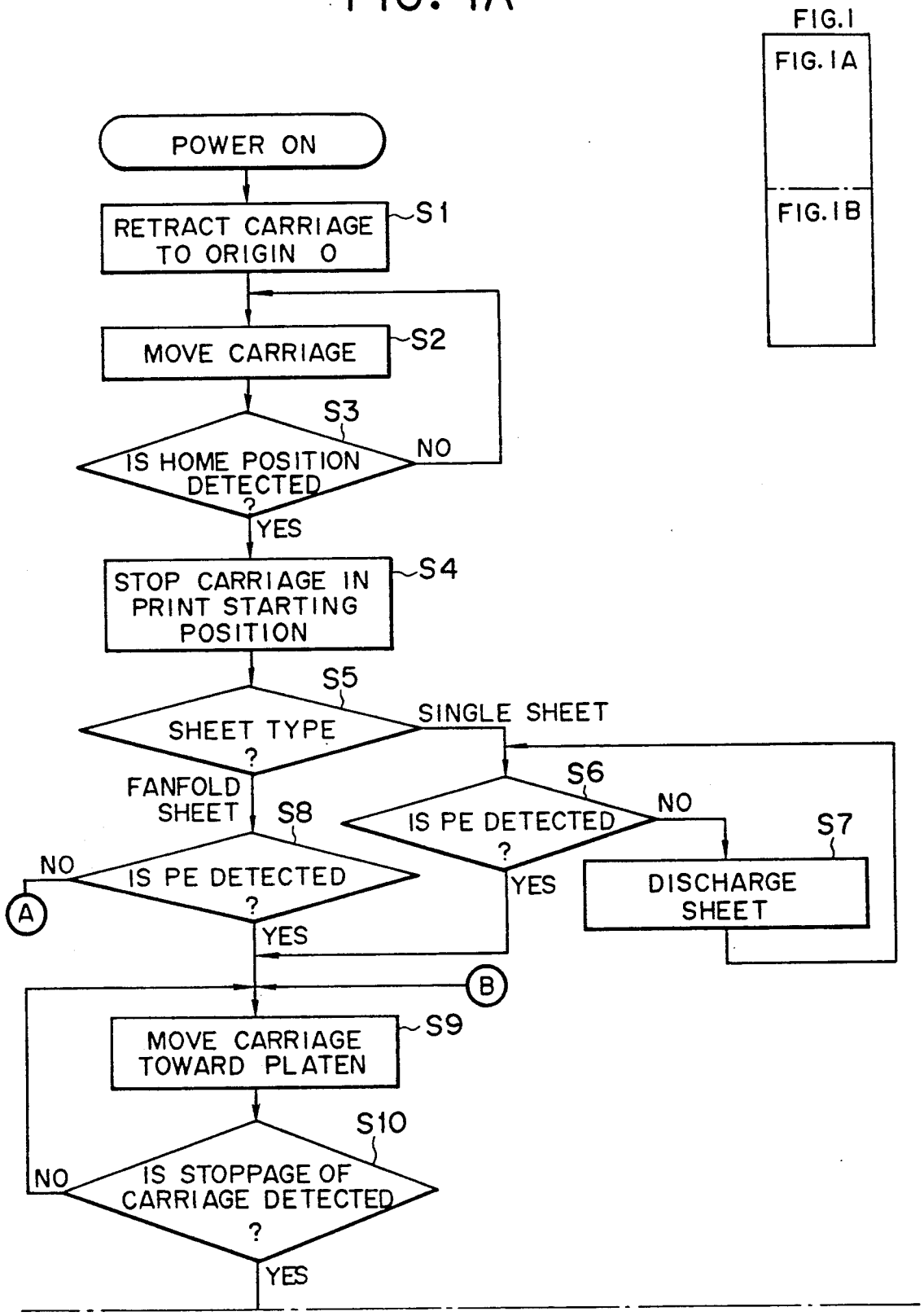

Steps S1 through S4 of the detailed flowcharts of FIGS. 1A–1B indicate a preparatory stage for a printing process, and move the carriage 1, which may be positioned anywhere with respect to the platen 2, to a print starting position. Specifically, the carriage 1 is retracted away from the platen 2 in the direction indicated by the arrow Y by the pressing/releasing mechanism 11, until the carriage 1 reaches and is stopped in the origin O. The carriage 1 is stopped in the origin O, i.e., the stepping motor 12 is de-energized, in response to an output signal from the encoder 22. More specifically, while the carriage 1 is moving away from the platen 2, the signal from the encoder 22 changes quickly between high and low levels. When the carriage 22 reaches the origin O, the signal from the encoder 22 no longer changes in level, and maintains its low or high level for a certain period of time. In response to detection by the CPU 24 of the maintained constant signal level from the encoder 22, the control device 23 de-energizes the stepping motor 12. Then, the carriage 1 is moved along the guide rod 3 until the arrival of the carriage 1 at its home position is detected in steps S2, S3. Thereafter, the carriage 1 is further moved a certain distance along the guide rod 3 and is stopped in the print starting position in a step S4.

The CPU 24 then determines in a step S5 whether the sheet 6 of print paper set in the printer is a single sheet or a fanfold sheet, based on the output signal from the sheet kind discriminator 28. If the sheet 6 of print paper is a single sheet, then the CPU 24 determines in a step S6 whether the sheet 6 of print paper is set on the platen 2 or not, i.e., whether a paper end (PE) is not detected, based on the output signal from the sheet sensor 7. If the sheet 6 of print paper is set on the platen 2, then the sheet 6 of print paper is discharged out of the printer by the sheet feed mechanism 10 in a step S7. After the sheet 6 of print paper is removed from the platen 2, control proceeds to a step S9. If the sheet 6 of print paper is a fanfold sheet in the step S5, then the CPU 24 determines in a step S8 whether the sheet 6 of print paper is set on the platen 2 or not. If not set on the platen 2, then control also goes to the step S9. If set on the platen 2, then control jumps to a step S17.

In steps S9 through S14, while no sheet of print paper is being set on the platen 2, the position of the carriage 1 at the time the ribbon mask 9 on the distal end of the carriage 1 is pressed against the platen 2 is detected with respect to each of a plurality of locations on the circumference of the platen 2. The reference position detecting means according to the present invention is implemented by these steps S9 through S14. More specifically, the CPU 24 applies drive pulses to the stepping motor 12 to move the carriage 1 from the origin O toward the platen 2 in the direction indicated by the arrow X with the pressing/releasing mechanism 11, in a step S9. The carriage 1 is moved toward the platen 2 until the ribbon mask 9 abuts against a circumferential surface of the platen 2 which may be in any angular position (see FIG. 4(*a*)). At this time, the carriage 1 is pressed against the platen 2 with a force corresponding to the spring force of the torsion coil spring 19. The driven gear 15 and hence the rotary disc 20 are stopped, and the stoppage of the rotary disc 20 is detected by the encoder 22 in a step S10, whereupon the CPU 24 de-energizes the stepping motor 12. The number NL1 of drive pulses that have been supplied to the stepping motor 12 until it is de-energized is stored in the RAM 26 as indicating a distance L1 (position) of the carriage 1 from the origin O in a step S11.

Thereafter, the CPU 24 energizes the stepping motor 12 to retract the carriage 1 to the origin O in a step S12. The platen 2 is then angularly moved 45 degrees, for example, about the axis 0 by the sheet feed mechanism 10 in a step S13. The carriage 1 now faces a different circumferential surface of the platen 2 since the platen 2 is in an angular position different from the angular position which was taken by the platen 2 in the step S9. Inasmuch as the platen 1 has not made one revolution yet by this time ("No" in a step S14), control returns to the step S9. The carriage 1 is moved against the platen 2 in the step S9 until the carriage 1 is stopped in the step S10. The number NL2 of drive pulses supplied to the stepping motor 12 until the carriage 1 is stopped is stored in the RAM 26 as indicating a distance L2 (position) of the carriage 1 from the origin O in the step S11. The carriage 1 is retracted to the origin O in the step S12, and then the platen 1 is further angularly moved 45 degrees in the step S13. The above process is repeated until the platen 1 makes one revolution ("Yes" in the step S14), as shown in FIGS. 4(*b*) and 4(*c*). Therefore, while the platen 1 is making one revolution through incremental angular movements, the numbers NL1 through NL8 of drive pulses supplied to the stepping motor 12 are detected and stored in the RAM 26 as indicating distances L1 through L8 of the carriage 1 from the origin O, i.e., the positions of the carriage 1 with respect to respective eight circumferential locations on the platen 2.

Then, the CPU 24 averages the distances L1 through L8 to provide a reference position as the average distance L from the origin O in a step S15. Actually, the average distance L is calculated as the average of the numbers NL1 through NL8 of drive pulses, and the average number NL of drive pulses is stored in the RAM 26. The step 15 serves as averaging means and memory means according to the present invention. Then, the sheet feed mechanism 10 feeds the sheet 6 of print paper and sets the same on the platen 2 in a step S16.

Figure 5:
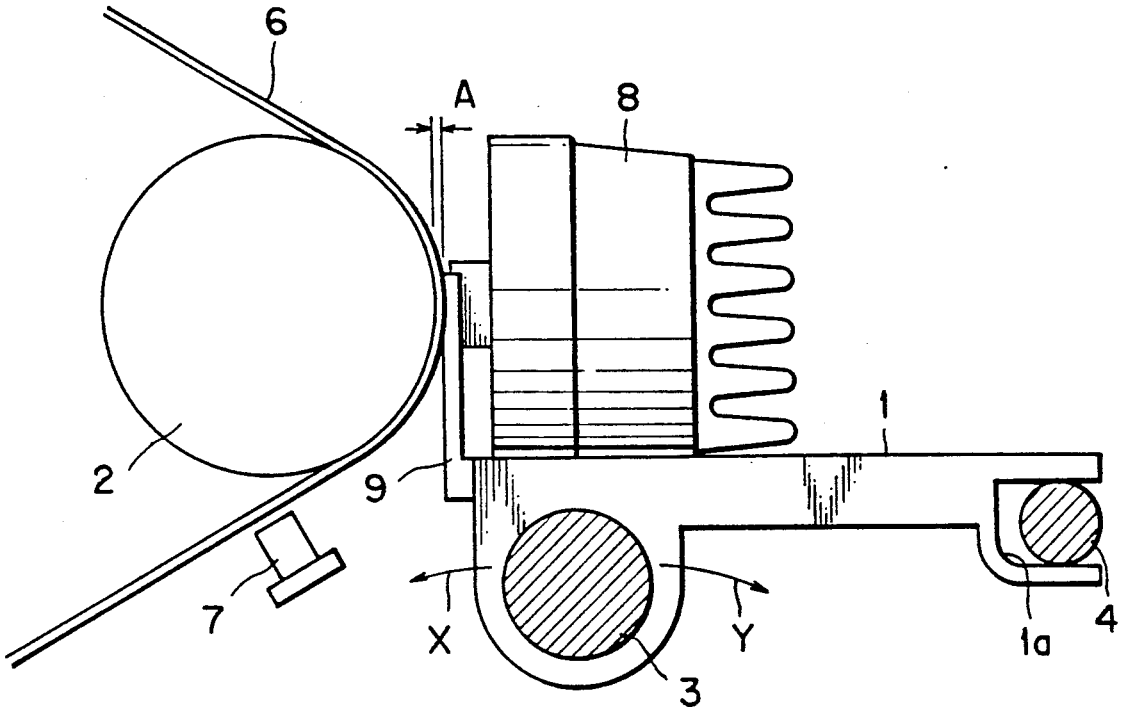
FIG. 5 is a vertical sectional side elevational view showing the manner in which the carriage is pressed against the sheet of print paper on the platen.

After the sheet 6 of print paper is set on the platen 2, the gap G is adjusted in steps S17 through S22 prior to starting of a printing process. First, the CPU 24 applies drive pulses to the stepping motor 12 to cause the pressing/releasing mechanism 11 to move the carriage 1 from the origin O toward the platen 2 in the direction indicated by the arrow X in a step S17. The carriage 1 is moved until it abuts against the sheet 6 of print paper on the platen 2, as shown in FIG. 5. The carriage 1 is pressed against the sheet 6 of print paper with a force corresponding to the spring force of the torsion coil spring 19. The driven gear 15 and hence the rotary disc 20 are stopped. In response to the detection by the encoder 22 of the stoppage of the rotary disc 20, the CPU 24 de-energizes the stepping motor 12 in a step S18. The number NM of drive pulses that have been supplied to the stepping motor 12 until it is de-energized is read as indicating a distance M (position) of the carriage 1 from the origin O in a step S19.

Figure 6:
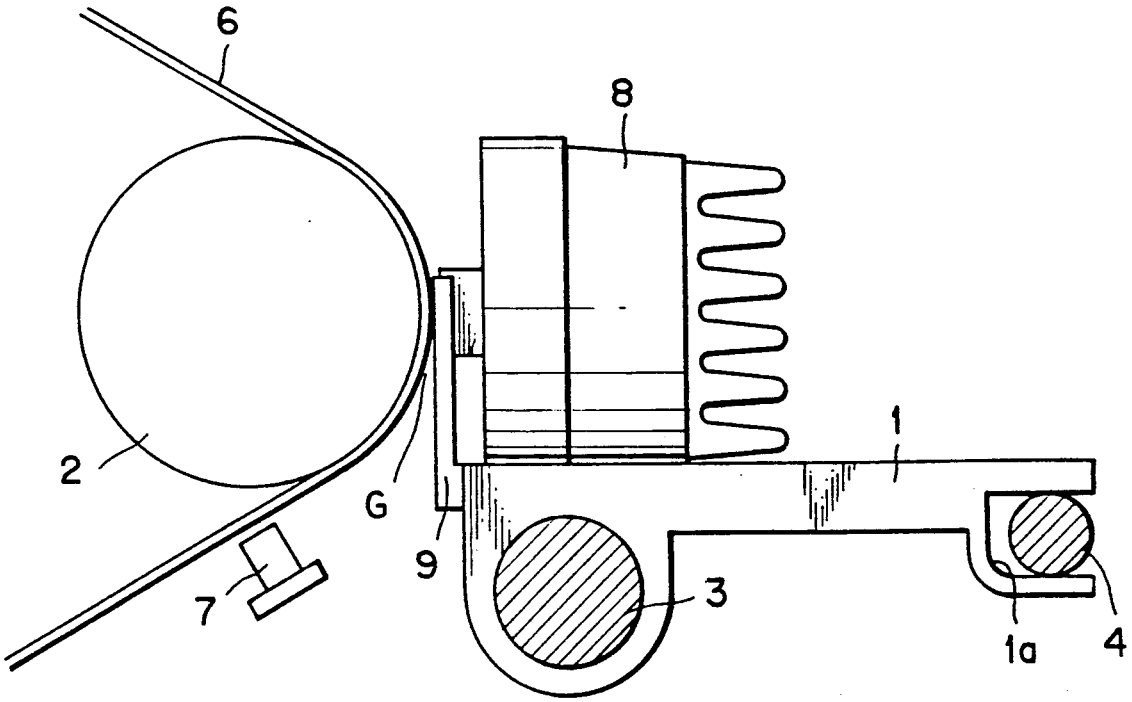
FIG. 6 is a vertical sectional side elevational view showing the position of the carriage when the adjustment of the gap is completed.

Steps S20 through S22 serve as adjusting means according to the present invention. The difference between the average distance L and the distance M, i.e., the difference between the average number NL of drive pulses which is stored in the RAM 26 and the average number NM of drive pulses, is calculated in a step S20. The difference between the average number NL of drive pulses and the number NM of drive pulses represents the number NA of drive pulses corresponding to the thickness A of the sheet 6 of print paper since the different between the average distance L and the distance M substantially corresponds to the thickness A of the sheet 6 of print paper. In a step S21, the CPU 24 reads the number NB of drive pulses corresponding to the calculated number NA of drive pulses from the data stored in the ROM 25. Then, the CPU 24 energizes the stepping motor 24 with as many drive pulses as the number NB for thereby retracting the carriage 1 from the sheet 6 of print paper, leaving the gap G between the sheet 6 of print paper and the print head 8 on the carriage 1, as shown in FIG. 6. The adjustment of the gap G between the sheet 6 of print paper and the print head 8 is now completed, allowing the printer to start printing desired information on the sheet 6 of print paper. If the sheet 6 of print paper is set on the platen 2 ("No" in the step 8) and hence no average number LN of drive pulses is detected, then the value of the average number LN of drive pulses which has been detected in a previous cycle and stored in the RAM 26 is used as the reference position in the step S20.

In the present embodiment, as described above, the carriage 8 is pressed successively against the eight circumferential surfaces of the platen 2 which are angularly spaced by 45 degrees, and the positions (represented by the numbers NL1 through NL8 of drive pulses supplied to the stepping motor 12) of the carriage 1 with respect to these different circumferential surfaces of the platen 2 are averaged into a reference position (the average number NL of drive pulses).

Heretofore, the position of the carriage with respect to the platen at the time the carriage is pressed against the platen at only one circumferential surface thereof is established as a reference position, and hence a suitable gap may not be created between the print head and the sheet of print paper when the rotational axis of the platen is displaced off the geometric central axis thereof. According to the present invention, however, even if the rotational axis 0 of the platen 2 is displaced off the geometric central axis thereof, as shown in FIGS. 4(*a*) through 4(*c*), there can be established a suitable reference position for the carriage 1 with respect to a standard circumferential surface of the platen 2 which is spaced from the rotational axis 0 thereof. As a result, an appropriate gap G can be produced between the sheet 6 of print paper and the print head 9 at all times.

During operation of the printer, the ink ribbon is prevented from getting caught by the print head 8, and desired information can be printed on the sheet 6 of print paper with a suitable ink density without undesirable omission of desired ink dots.

Furthermore, the reference position (the average number NL of drive pulses) for the carriage 1 in use is detected when no sheet 6 of print paper is set on the platen 2 each time the power supply of the printer is turned on. Consequently, unlike printers which have reference carriage positions fixed at the time they start to be used are shipped from the factory, a highly reliable reference position can be established for the carriage 1 even if the platen 2 may be flexed or otherwise deformed after long usage.

While the reference position for the carriage 1 is detected and stored each time and immediately after the power supply of the printer is turned on in the illustrated embodiment, the reference position may be established only when the printer is shipped from the factory or occasionally at certain time intervals. The gap G may remain unchanged irrespective of the thickness of the sheet 6 of print paper used.

Although a certain preferred embodiment has been shown and described, it should be understood that many changes and modifications may be made therein without departing from the scope of the invention.

With the present invention, as described above, even if the rotational axis of the platen is displaced off the geometric central axis thereof, there can be established a suitable reference position for the carriage with respect to a standard circumferential surface of the platen which radially spaced from the rotational axis thereof. Consequently, the gap between the sheet of print paper and the print head can appropriately be adjusted, and the printer can print desired information suitably on the sheet of print paper.

What is claimed is:

1. A printer comprising:

a power supply switch for actuating the printer when said power supply switch is turned on;

a platen rotatable about its own axis for supporting a sheet of print paper on a circumference thereof;

a guide rod extending in parallel to the axis of said platen;

a carriage slidably movable along said guide rod and also movable toward and away from said platen in a direction substantially perpendicular to the axis of said platen, said carriage having a distal end portion confronting said platen;

a print head mounted on said carriage for carrying out printing on the sheet of print paper while said carriage is moving along said guide rod;

a pressing/releasing mechanism for moving said carriage toward and away from said platen;

reference position detecting means for detecting a plurality of reference positions of said carriage in the direction perpendicular to the axis of said platen under a condition where no sheet of print paper is supported on said platen, the plurality of reference positions being defined by positions of the distal end portion of said carriage when pressed against a plurality of locations on the circumference of said platen by said pressing/releasing mechanism, said platen being angularly rotated about its own axis when the plurality of reference positions are detected, said reference position detecting means producing a plurality of reference position data each indicative of the detected reference position of said carriage;

averaging means for averaging the plurality of reference position data produced by said reference position detecting means and producing average reference position data indicative of an averaged reference position of said carriage;

memory means for storing the average reference position data; and adjusting means for adjusting a position of said carriage by actuating said pressing/releasing mechanism based on the average reference position data stored in said memory means.

2. A printer according to claim 1, further comprising sheet thickness detecting means for detecting a thickness of the sheet of print paper supported on said platen, said sheet thickness detecting means producing sheet thickness data indicative of the detected thickness of the sheet of print paper, and wherein said adjusting means adjusts the position of said carriage based further on the sheet thickness data.

3. A printer according to claim 2, wherein said pressing/releasing mechanism includes a motor for actuating said pressing/releasing mechanism, said motor being rotated when drive pulses are supplied thereto, and wherein each of the plurality of reference position data is in the form of a number of drive pulses supplied to said motor needed for moving said carriage from a predetermined position spaced apart a predetermined distance from the circumference of said platen to the reference position, the average reference position data represents an average number of the drive pulses, and the sheet thickness data is in the form of a number of drive pulses corresponding to the thickness of the sheet of print paper.

4. A printer according to claim 3, wherein said sheet thickness detecting means counts a number of drive pulses supplied to said motor during a movement of said carriage from the predetermined position until the distal end portion of said carriage is pressed against the sheet of paper supported on said platen, and produces the sheet thickness data by subtracting the counted number of drive pulses from the average number of the drive pulses represented by the average reference position data.

5. A printer according to claim 4, wherein said memory means further stores carriage position data regarding optimum positions of said carriage to be located apart from the sheet of print paper supported on said platen in relation to the sheet thickness data, the position of said carriage being adjusted by said adjusting means in response to the carriage position data corresponding to the sheet thickness data produced by said sheet thickness detecting means.

6. A printer according to claim 5, wherein said adjusting means adjusts the position of said carriage by moving said carriage away from the sheet of print paper supported on said platen.

7. A printer according to claim 6, wherein the carriage position data is in the form of a number of drive pulses supplied to said motor.

8. A printer according to claim 7, wherein the number of drive pulses representing the carriage position data is determined so that an optimum distance is reserved between said print head and the sheet of print paper supported on said platen depending on the thickness of the sheet of print paper detected by said sheet thickness detecting means.

9. A printer according to claim 1, wherein said memory means further stores carriage position data regarding a position of said carriage to be located apart from the sheet of print paper supported on said platen, and wherein said adjusting means adjusts the position of said carriage by moving said carriage away from the sheet of print paper supported on said platen.

10. A printer according to claim 1, wherein said pressing/releasing mechanism includes a motor for actuating said pressing/releasing mechanism, said motor being rotated when drive pulses are supplied thereto, and wherein the carriage position data is in the form of a number of drive pulses supplied to said motor, the number of drive pulses being constant irrespective of a thickness of the sheet of print paper supported on said platen.

11. A printer according to claim 1, wherein detections of the plurality of reference positions by said reference position detecting means are implemented whenever said power supply switch is turned on.

12. A printer according to claim 1, further comprising sheet sensing means for sensing an absence of the sheet of print paper on said platen, said sheet sensing means producing a sheet absence signal indicative of the absence of the sheet of print paper on said platen.

13. A printer according to claim 12, wherein the plurality of reference positions are detected by said reference position detecting means when the sheet absence signal is produced from said sheet sensing means.

14. A printer according to claim 12, wherein said platen is rotated when the sheet absence signal is not produced from said sheet sensing means to discharge the sheet of print paper loaded on said platen.

15. A printer according to claim 14, wherein the plurality of reference positions are detected by said reference position detecting means when the sheet absence signal is produced from said sheet sensing means as a result of the discharge of the sheet of print paper.

16. A printer according to claim 12, wherein the plurality of reference positions are not detected by said reference position detecting means when the sheet absence signal is produced from said sheet sensing means but the position of said carriage is adjusted by said adjusting means based on the average reference position data previously stored in said memory means.

17. A printer according to claim 1, wherein said print head is of a dot-matrix-impact type having print wires on a distal end thereof, the print wires projecting toward said platen to thus make dot impression on the sheet of print paper supported on said platen.

* * * * *